United States Patent [19]

Crocker et al.

[11] Patent Number: 4,553,384

[45] Date of Patent: Nov. 19, 1985

[54] TAKE-UP SHAFT GUARD FOR OPEN-END YARN SPINNING MACHINE

[75] Inventors: Charles L. Crocker; Michael Wallace, both of Greensboro; Lee Powell, Mooresville, all of N.C.

[73] Assignee: Burlington Industries, Inc., Greensboro, N.C.

[21] Appl. No.: 683,229

[22] Filed: Dec. 18, 1984

[51] Int. Cl.[4] ..... D01H 1/12; D01H 13/02

[52] U.S. Cl. ..... 57/406; 57/90; 57/404; 226/181; 226/190; 226/194

[58] Field of Search ..... 57/90, 91, 1 R, 400, 57/404–407, 414–417; 226/168, 181, 190, 194, 196; 74/608, 609, 616, 612, 613

[56] References Cited

U.S. PATENT DOCUMENTS

| | | | |
|---|---|---|---|
| 1,302,626 | 5/1919 | Bloom | 57/90 |
| 1,499,694 | 7/1924 | Rogers | 74/609 X |
| 1,659,521 | 2/1928 | Dye | 226/194 |
| 1,720,447 | 7/1929 | Sarfert et al. | 57/90 |
| 1,751,210 | 3/1930 | Leonard | 57/90 |
| 3,355,868 | 12/1967 | Civrny et al. | 57/404 |
| 3,462,057 | 8/1969 | Yamamoto | 226/181 |
| 3,590,568 | 7/1971 | Kubovy | 57/404 X |
| 3,734,373 | 5/1973 | Dattilo | 226/190 X |
| 4,055,938 | 11/1977 | Clayton | 57/404 |
| 4,138,132 | 2/1979 | Doyle | 74/608 X |

FOREIGN PATENT DOCUMENTS

| | | | |
|---|---|---|---|
| 158542 | 9/1953 | Australia | 74/609 |
| 1378141 | 12/1974 | United Kingdom | 74/609 |
| 1564852 | 4/1980 | United Kingdom | 74/609 |

OTHER PUBLICATIONS

Schlaforst Shaft Cover, Nov. 1, 1983.

*Primary Examiner*—John Petrakes
*Attorney, Agent, or Firm*—Cushman, Darby & Cushman

[57] ABSTRACT

A guard is provided for a take-up shaft of an open-end yarn spinning machine. The shaft rotates about a first axis and cooperates with a cot (a small rubber wheel) which is rotatable about a second axis parallel to the first axis. The guard comprises a tubular body member, preferably circular in cross-section, having a central axis and first and second ends spaced from each other along the central axis. A slot is formed in the body, and the body surrounds the shaft. The body is concentric with the shaft and the slot is disposed beneath the shaft. A cut-out is formed adjacent, but spaced from, the first end of the shaft, and the cot operatively engages the shaft through the cut-out. The slot and cut-out preferably interconnect. A mounting bracket is joined to the body member at the second end of the body member preferably comprises a Y-shaped bracket having a stem integral with the body member and branches with openings for receipt of fasteners. The fasteners are otherwise operative components of the spinning machine, and the fasteners and bracket mount the tubular body member so that it is stationary with respect to the shaft. The body member preferably is formed of a flexible plastic so that the portions thereof defining the slot may be bent away from each other, and the body member easily disposed in a position surrounding the shaft, although it may also be of a rigid metal.

22 Claims, 5 Drawing Figures

TAKE-UP SHAFT GUARD FOR OPEN-END YARN SPINNING MACHINE

BACKGROUND AND SUMMARY OF THE INVENTION

Conventional open-end yarn spinning machines, such as the Schlaforst Auto-Coro machine, include a take-up shaft located above most of the other machine parts. The take-up shaft cooperates with a small rubber wheel known in the trade as a "cot" which is in operative contact with the shaft, and yarn being spun passes between the shaft and the cot as it is being pulled out of the spin box of the machine. Since the shaft rotates at high speed and is in an exposed location, it can present a safety hazard to operators.

According to the present invention, a guard is provided for the take-up shaft of an open-end yarn spinning machine, particularly the Schlaforst Auto-Coro machine, that eliminates or minimizes the possibility that an operator will be injured by coming into contact with the shaft as it is rotating at high speed. The guard according to the invention is easy to mount and place on the machine, easy to install in operative position surrounding the shaft, allows lint or trash on the shaft to be discharged, and does not at all interfere with the cooperation between the cot and the shaft, yet the guard positively prevents an operator from putting his/her finger in contact with the shaft.

The guard according to the invention comprises a tubular body member having a central axis with first and second ends spaced along the central axis. A slot is formed in the body member extending from the first end to the second end thereof, and generally parallel to the second axis, and a cut-out is formed in the body member adjacent, but spaced from, the first end. The cut-out is elongated both circumferentially and axially. A mounting bracket is connected to the body member adjacent the second end thereof and extends in a plane generally transverse to the central axis. The mounting bracket preferably comprises a Y-shaped bracket having the stem integral with the body member, and a pair of branches each of which receives a fastener passing therethrough.

In use, the bracket mounts the body member so that the body member surrounds the shaft, with the central axis parallel to the axis of rotation of the shaft, and with the cot engaging the shaft through the cut-out. The slot is at the bottom of the body member so that lint and trash will fall out under the force of gravity. The bracket is mounted by screws that are otherwise operative components of the machine, and the bracket and body member are held stationary with respect to the shaft.

Preferably the body member is formed of a flexible plastic so that the portions thereof defining the slot may be grabbed and moved away from each other, to allow the guard to be simply slipped over a shaft even though the shaft has a diameter significantly greater than the width of the slot. The bracket and body member may be an integral piece of injection molded plastic. Alternatively they are molded separately and bonded together with adhesive. They also may be made of other suitable materials, such as rigid or flexible pieces of metal.

It is the primary object of the present invention to provide a practical safety device for the rotating take-up shaft of an open-end yarn spinning machine. This and other objects of the invention will become clear from an inspection of the detailed description of the invention, and from the appended claims.

DETAILED DESCRIPTION OF THE DRAWINGS

Figure 1:
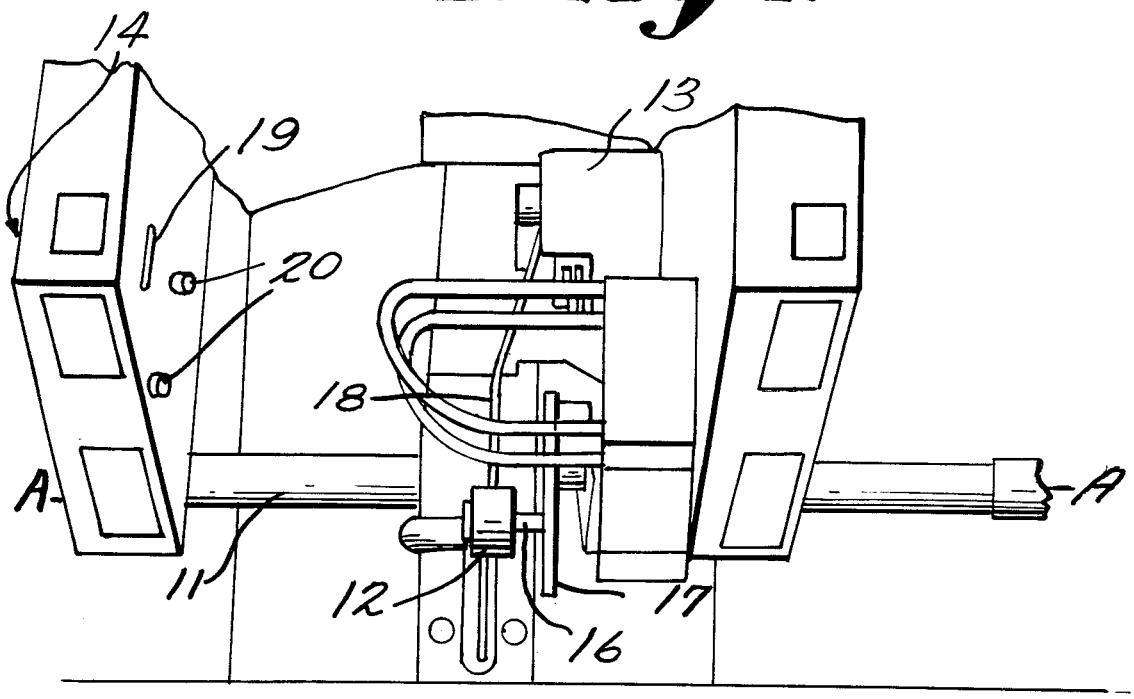
FIG. 1 is a top perspective view at the take-up shaft of a conventional Schlaforst Auto-Coro open-end spinning machine.

A conventional Schlaforst Auto-Coro open-end yarn spinning machine is illustrated in FIG. 1. Significant components thereof as far as the invention is concerned include a take-up shaft 11, a cot (small rubber wheel) 12, a spin box 13, and a control panel 14. The yarn spinning machine comprises a plurality of different spin boxes and associate control panels and cots, each cooperating with a different section of the take-up shaft 11.

The shaft 11 is rotated at high speed about a first axis A—A. The cot is mounted for rotation about pin 16, which is mounted on lever arm 17. The cot 12 is rotatable about a second axis, defined by the pin 16, which is spaced from but essentially parallel to the first axis A—A. As can be seen in FIG. 1, the cot engages the external periphery of a portion of the shaft 11, and yarn 18 being spun passes between the shaft 11 and the cot 12, being drawn from the spin box 13. The control panel 14 includes a metal side plate 19 having screws 20 associated therewith for holding the control panel components together.

Figure 2:
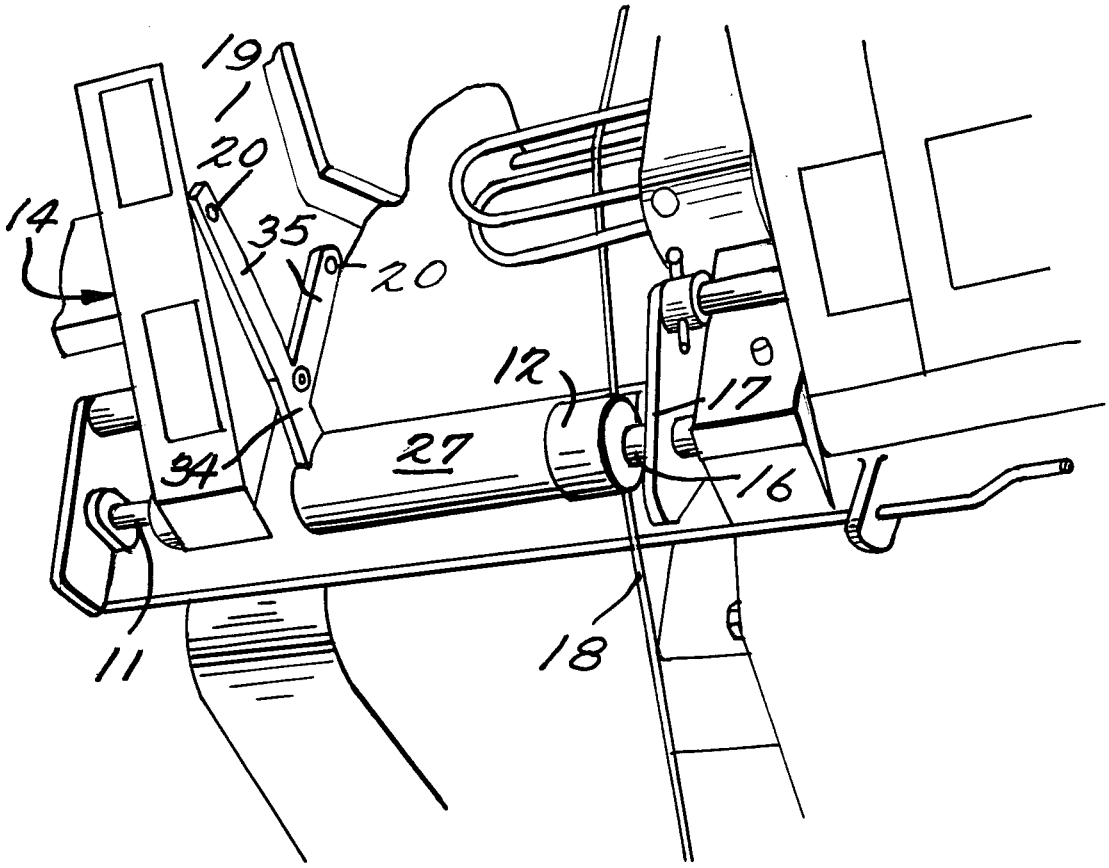
FIG. 2 is a bottom perspective view of the machine of FIG. 1 only showing the guard according to the invention in operative association with the take-up shaft.
Figure 3:
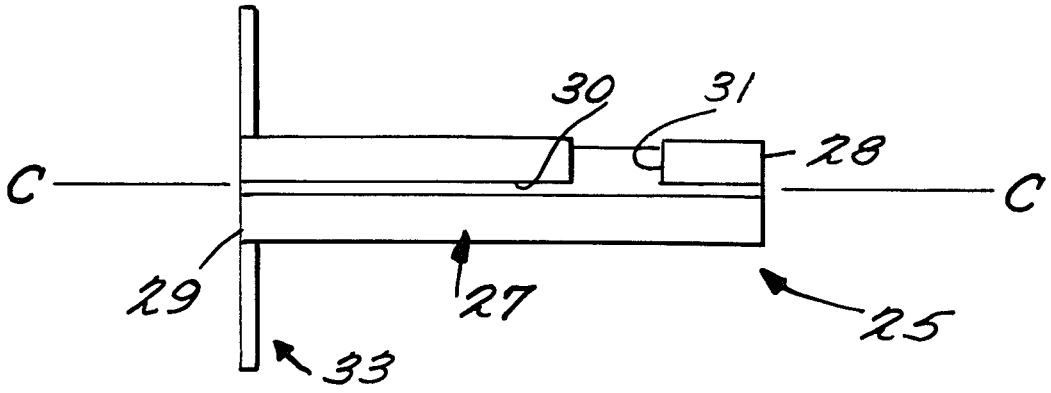
FIG. 3 is a bottom plan view of the guard of FIG. 2.
Figure 4:
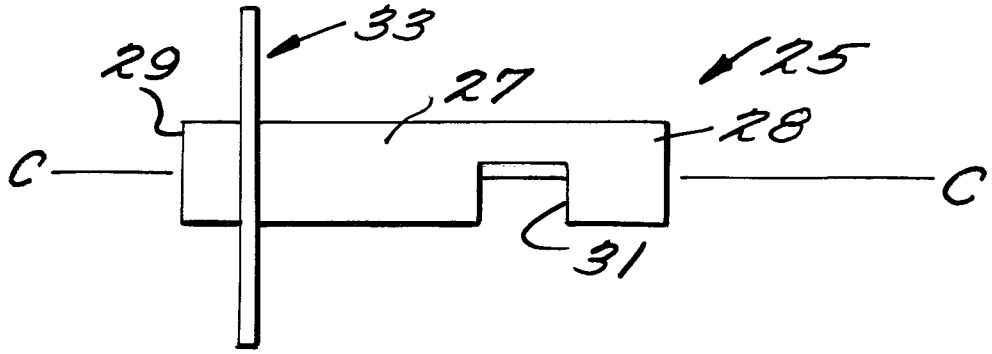
FIG. 4 is a top plan view of a guard like that of FIG. 3 only differing slightly in dimensions and relative positions of components.
Figure 5:
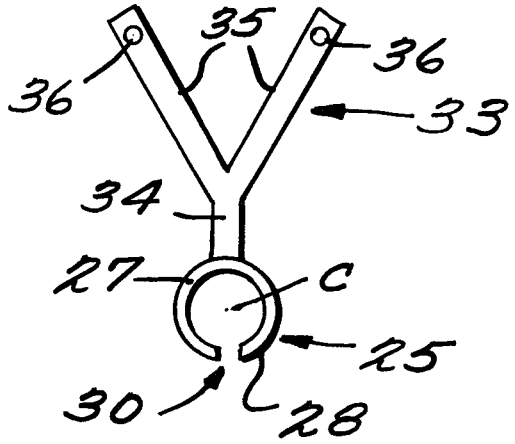
FIG. 5 is a front end view of the guards of FIGS. 3 and 4.

FIG. 2 illustrates the identical machine illustrated in FIG. 1, only it shows a guard means, shown generally by reference numeral 25 in association with the rest of the machine components. The guard means 25 is also illustrated in FIGS. 3 through 5, and comprises a tubular body member 27 (which is preferably, although not necessarily, circular in cross-section) having a central axis C—C, and a first end 28 and a second end 29. Means are provided defining a slot 30 in the tubular body member 27. The slot 30 has a width substantially less than the diameter of the take-up shaft 11. Slot 30 preferably extends from the first end 28 all the way through to the second end 29 of the body 27, and—as illustrated in FIGS. 3 and 5 in particular—is essentially parallel to the axis C—C.

The guard means 25 also comprises means defining a cut-out 31 in the body member 27, adjacent, but spaced from, the first end 28. The cut-out 31 is elongated both axially (parallel to the axis C—C), and arcuately, around the circumference of the body 27. As illustrated in the drawings, the arcuate extent of the cut-out 31 preferably will be around 180 degrees. By providing such an arcuate extent, and providing an axial dimension slightly greater than the width of the cot 12, the cut-out 31 will allow the cot 12 to engage the periphery of the shaft 11 in an unimpeded manner (see FIG. 2) when the guard 25 is in place.

Means are also provided for mounting the body 27 to the rest of the machine so that the body 27 is stationary with respect to the shaft 11, and circumferentially surrounds the shaft 11, with the axes A—A and C—C being essentially coincident (i.e. the shaft 11 and the tube 27 are concentric). Such mounting means preferably takes the form of a Y-shaped bracket, illustrated generally by reference numeral 33. The bracket 33 is mounted adjacent the second end 29. Preferably, as can be seen most clearly in FIGS. 2 and 5, the bracket 33 is Y-shaped, having a stem 34 which is connected to the body member 27, and having a pair of branches 35 each of which has a fastener-receiving opening 36 therein. The bracket 33 extends generally transverse to the central axis C—C. The openings 36 are positioned with respect to each other, and the tubular body member 27, so that the screws 20, which are already operative components of the spinning machine, can pass therethrough and hold the branches 35 to the control panel side plate 19, so that no additional mounting hardware is necessary (although it may be desirable to lengthen the screws 20 slightly).

While the body 27 may be made of any suitable material, it is preferred that it be made of a flexible plastic, such as CAB plastic. This allows the installer to grab the edges of the body member 27 defining the slot 30, and pull them apart so that the tubular body member 27 may easily be snapped directly over the shaft 11 even though the diameter of the shaft 11 is significantly greater than that of the slot 30 (though less than the interior diameter of the member 27). The bracket 33 and body member 27 may be formed of a single integral piece of plastic, such as a piece of injection molded plastic. Preferably, the bracket 33 and body 27 are separately molded pieces of plastic that are joined together with adhesive. Alternatively both components may be of metal (e.g. bracket 33 of steel and body 27 of brass, suitably joined together).

Note that various dimensions of the guard 25 will differ depending upon its exact position in the spinning machine. For instance in some particular locations, the bracket 33 is adjacent, but spaced from, the second end 29 (see FIG. 4), and the exact distance the cut-out 31 is spaced from the first end 28 also depends upon the particular circumstances. In any event, it is desired that the tubular member 27 have sufficient axial extent so that it essentially covers all exposed portions of the shaft 11.

In the utilization of the guard 25, the operator first grasps the portions thereof defining the slot 30, moves them apart, and clips them over the shaft 11, with the slot 30 facing generally downwardly and the bracket stem 34 extending generally upwardly (the bracket stem 34 being located approximately 180 degrees around the circumference of the tubular member 27 from the slot 30). Then the operator makes sure that the cot 12 is properly received in the cut-out 31, and then passes the screws 20 through the openings 36 in the branches 35 to affix the bracket 33 to the plate 19. In this position the tubular member 27 is mounted so that it surrounds, and is concentric with, the shaft 11, is stationary with respect to the shaft 11, and the slot 30 is disposed along the bottom thereof so that lint or trash that may accumulate on the shaft will fall out the bottom under the force of gravity.

It will thus be seen that according to the present invention a simple and inexpensive, yet practical and effective guard is provided for a rotating take-up shaft of an open-end yarn spinning machine (such as a Schlaforst Auto-Coro machine). While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A guard adapted to be utilized with a take-up shaft and cot associated with an open-end yarn spinning machine, said guard comprising:

a tubular body member having first and second ends spaced from each other along a central axis of said tubular body member;

means defining a slot in said tubular body member, said slot extending axially the length of said tubular body member from said first to said second end thereof, and essentially parallel to said central axis;

means defining a cut-out in said tubular body member adjacent, but spaced from, said first end thereof, said cut-out elongated both circumferentially and axially and having circumferential and axial dimensions sufficient so that a cot of a yarn spinning machine may extend into contact with a shaft extending through the guard; and a mounting bracket connected to said tubular body member adjacent said second end thereof, said mounting bracket extending in a plane generally transverse to said central axis.

2. A guard as recited in claim 1 wherein said mounting bracket comprises a Y-shaped mounting bracket including a stem portion and a pair of branches extending outwardly from said stem portion.

3. A guard as recited in claim 2 further comprising means defining a fastener-receiving opening in each of said branches for passage of a fastener therethrough to hold said mounting bracket in place during use.

4. A guard as recited in claim 3 wherein said cut-out and said slot interconnect.

5. A guard as recited in claim 2 wherein said stem is joined to said body at a position approximately 180 degrees arcuately along said tubular body from said slot.

6. A guard as recited in claim 2 wherein said Y-shaped mounting bracket and said tubular body are molded as separate pieces of plastic, and are joined together with adhesive.

7. A guard as recited in claim 1 wherein said cut-out and said slot interconnect.

8. A guard as recited in claim 1 wherein said cut-out extends arcuately approximately 180 degrees.

9. A guard as recited in claim 1 wherein said tubular body is a flexible plastic so that said tubular body may be bent outwardly from said slot and placed around a shaft having a diameter significantly larger than the width of said slot.

10. A combination comprising:

a take-up shaft of an open-end yarn spinning machine, rotatable about a first axis;

a cot rotatable about a second axis spaced from, but parallel to, said first axis, and in operative association with said shaft;

stationary guard means associated with said shaft and cot for preventing an operator from coming into contact with the rotating shaft, while allowing lint, trash, or the like from the shaft to be discharged from said guard means; and said guard means comprising a tubular body having a central axis, and first and second ends spaced from each other along said central axis; means defining a slot in said body member extending generally parallel to said central axis; means defining a cut-out in said body member; and mounting means for mounting said body member so that it is stationary with respect to said shaft with said central axis concentric with said first axis, with said body member surrounding said shaft and with said cot in operative association with said shaft through said cut-out in said body member.

11. A combination as recited in claim 10 wherein said slot extends the entire length of said tubular body member, and wherein said slot is located beneath said shaft.

12. A combination as recited in claim 11 wherein said tubular body is a flexible plastic so that said tubular body may be bent outwardly from said slot and placed around a shaft having a diameter significantly larger than the width of said slot.

13. A combination as recited in claim 12 wherein said mounting means comprises a mounting bracket of the same plastic material as said tubular body, said mounting bracket extending outwardly from said tubular body member generally transverse to said central axis from a point adjacent said second end of said tubular body member, and approximately opposite said slot.

14. A combination as recited in claim 11 wherein said cut-out and said slot interconnect.

15. A combination as recited in claim 14 wherein said tubular body member is circular in cross-section.

16. A combination as recited in claim 15 wherein said cut-out extends arcuately approximately 180 degrees.

17. A combination as recited in claim 10 wherein said mounting means comprises a mounting bracket extending outwardly from said tubular body member in a plane generally transverse to said central axis, and adjacent said second end of said tubular body member.

18. A guard as recited in claim 17 wherein said mounting bracket comprises a Y-shaped mounting bracket including a stem portion and a pair of branches extending outwardly from said stem portion.

19. A combination as recited in claim 18 further comprising a fastener extending through each of said branches of said mounting bracket and extending into operative engagement with said yarn spinning machine, each of said fasteners being otherwise operative components of said yarn spinning machine.

20. A combination as recited in claim 18 wherein said stem is joined to said tubular body member at a point adjacent, but spaced from, said second end of said body member.

21. A combination as recited in claim 17 wherein said body and said bracket are both of metal.

22. A guard as recited in claim 1 wherein said body member and said bracket are both of metal.

* * * * *